United States Patent [19]

Jacobsson

[11] 4,259,851

[45] Apr. 7, 1981

[54] POSITIVE THREAD-DELIVERY DEVICE FOR TEXTILE MACHINES

[75] Inventor: Kurt A. G. Jacobsson, Ulricehamn, Sweden

[73] Assignee: Aktiebolaget IRO, Ulricehamn, Sweden

[21] Appl. No.: 68,320

[22] Filed: Aug. 21, 1979

[30] Foreign Application Priority Data

Jul. 25, 1978 [DE] Fed. Rep. of Germany ..... 2836717

[51] Int. Cl.[3] ..... D04B 15/48; D04B 15/50

[52] U.S. Cl. ..... 66/132 T; 66/160; 66/163; 242/47.01; 200/61.18

[58] Field of Search ..... 66/132 T, 132 R, 146, 66/157, 158, 160, 161, 163; 242/47.01; 200/61.18

[56] References Cited

U.S. PATENT DOCUMENTS

| | | | |
|---|---|---|---|
| 1,358,438 | 11/1920 | Wachsman | 66/161 |
| 3;264,845 | 8/1966 | Rosen | 66/132 |
| 3,343,008 | 9/1967 | Bancroft | 200/61.18 X |
| 3,418,831 | 12/1968 | Nance | 66/132 |
| 3,521,265 | 7/1970 | Bancroft | 200/61.18 X |
| 3,802,228 | 4/1974 | Deniega | 66/132 T |
| 3,922,887 | 12/1975 | Mischon | 66/132 T |
| 3,950,966 | 4/1976 | diCarlo | 66/132 T |
| 4,043,153 | 8/1977 | Stienberg et al. | 66/163 X |

*Primary Examiner*—Ronald Feldbaum

*Attorney, Agent, or Firm*—Blanchard, Flynn, Thiel, Boutell & Tanis

[57] ABSTRACT

A positive thread-delivery device for a textile, in particular a knitting, machine with a plurality of thread-guiding rollers, with which cooperates a common delivery belt and with which each one a thread-control element is associated, which thread-control element during the delivery of the thread holds same in a clamping position between the delivery belt and the thread-guiding roller and which during a drop in the tension of the thread which is delivered by the thread-delivery device can be changed over into a position in which it guides the thread over an area of the thread-guiding roller which is free of the delivery belt to thus terminate the thread delivery, and a tension feeler is provided which engages, independently from the thread-control element, the thread which is delivered by the thread-delivery device, which feeler operates an electromagnet which loads the thread-control element.

8 Claims, 1 Drawing Figure

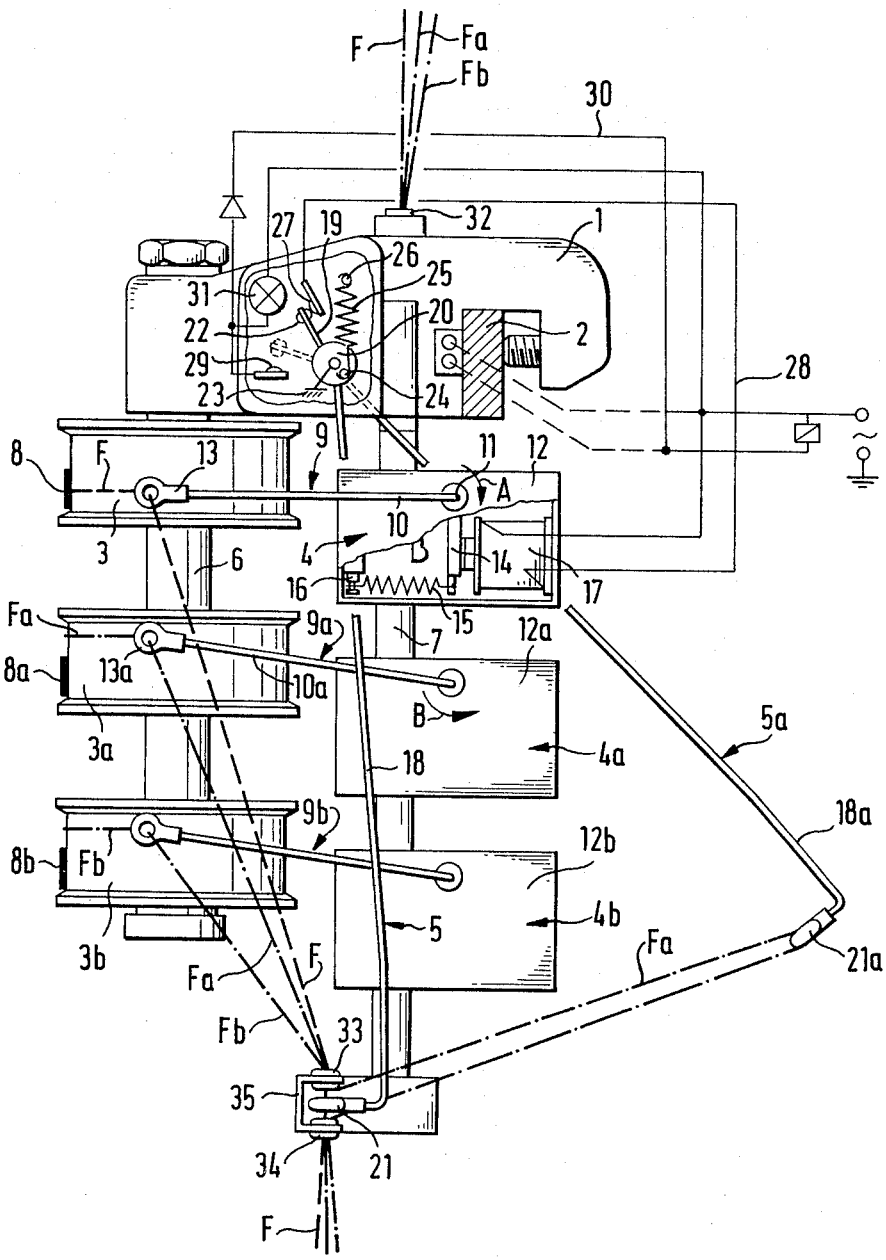
F
Fa
Fb
30
32
1
27
19
26
25
31
20
22
2
29
23
24
28
8
F
13
9
11
12
A
10
3
6
4
B
14
16
15
17
Fa
9a
7
12a
8a
13a
10a
B
5a
3a
18
4a
9b
18a
8b
Fb
12b
5
4b
3b
Fa
F
Fa
21a
Fb
33
35
34
21
F

POSITIVE THREAD-DELIVERY DEVICE FOR TEXTILE MACHINES

FIELD OF THE INVENTION

The invention relates to a positive thread-delivery device for a textile machine, specifically a circular knitting machine.

BACKGROUND OF THE INVENTION

A thread-delivery device is known from German AS No. 1,585,298. It has, as a thread-control element, two levers which are connected through a common axle approximately in a U-shape and are supported swingably by means of same in planes which are parallel with respect to the axis of the thread-guiding roller. The levers extend on both sides of the thread-guiding roller and each carries at its end an eyelet for the thread. A spring engages the common axle. It is initially tensioned such that it holds or urges the levers in a rest position in which the thread which is guided through the two eyelets rests on an area of the thread-guiding roller which is free from the delivery belt. This position is possible if the thread is not exposed to any tension. If the thread is delivered or consumed by the textile machine, the tension of the delivered thread is sufficient to swivel the levers against the force of the spring so that the thread runs in the area of the thread-guiding roller on which also runs the delivery belt, which thereby conveys the thread. If less thread is consumed, then the withdrawal tension of the thread becomes less, the levers move upwardly and the thread delivery is interrupted. At the same time trip cams which are arranged on the lever axis switch on a signal lamp and/or switch off the machine drive. The time period needed in order for the spring to pull the thread out from between the delivery belt and thread-guiding roller, such as during a tension drop, is too great for some purposes. This is true, for example, when working on a stripe machine, which produces color-striped goods and therefore often changes between different threads at every thread processing location. This change must occur quickly and exactly, and the thread which is not in operation, which is separated and clamped at the processing location, should not continue to be delivered. It is not possible to increase the force of the spring in order to speed up the lever movement, since the spring force and the tension of the delivered thread must be adjusted directly to one another for the correct function during the delivery, and the thread tension is supposed to be maintained as low as possible.

The purpose of the invention is to construct a device of the described type with simple means so that the thread delivery, upon a dropping in the tension of the delivered thread, is interrupted within the shortest period of time.

The inventive device accelerates the interruption of the thread delivery substantially through the cooperation of several factors: The tension feeler, forcedly disposed in the path between the thread-control element and the processing location, experiences a tension change before the tension change reaches the thread-control element itself. Its reaction movement does not move the thread itself proportionally to said movement, but results in a naturally very quick electric switching operation, to which an electromagnet reacts. Its mechanical coupling with the thread-control element can, since it does not have any influence on the delivery tension of the thread, work with any desired force input or any suitable movement ratio, so that the thread-control element can instantaneously move the thread out of the area of the delivery belt. A further advantage of the device consists in the tension feeler changing, during its movement, the thread path of the unwinding thread. The small amount of thread which is subsequently delivered, in spite of the quick interruption, is absorbed by this detour or changing of the thread path.

For a device of the above-described type, with a swingably supported thread-control element which is loaded by a spring in a direction toward the position which guides the thread over the delivery-belt-free area, the spring can advantageously be engaged at the free end of a magnetic arm, which arm is connected to the thread-control element in the area of its swivel axis, and the electromagnet can be arranged adjacent to the arm so that it swivels same, when switched on, against the spring force.

In this embodiment, the unwinding thread on the one hand and the spring on the other hand are still in direct mechanical connection with the thread-control element. The direct reciprocal force effect is, however, interrupted by the electromagnet, which acts in dependency from the thread tension against the spring. The spring force in this manner does not at all effect the spring tension, which through this can be kept low in the desired manner. The spring can, however, be designed stronger than is possible in a direct connection. During release from the electromagnet, the spring correspondingly quickly swivels the thread-control element and ends the thread delivery. Just as quickly the electromagnet takes care of the swivelling of the thread-control element into the delivery area, when the thread is again grabbed and tensioned at the processing location. The thread tension must not first build up which is capable of overcoming the spring tension.

In an advantageously simple manner it is possible for the tension feeler to have two lever arms with one thread eyelet for the delivered thread at the free end of the first lever arm and a contact piece at the end of the second lever arm, which feeler can be spring-loaded swingably supported such that the contact piece, during delivery of the thread, closes the circuit of the electromagnet and opens same during a drop in the tension. A minimum swivelling path is needed for the opening and closing of the contact. It can additionally be influenced by the length relationship of the two lever arms, so that the spring which engages the tension feeler can be very weak and has no significant influence on the thread tension.

An advantageous arrangement of the tension feeler in the thread path is achieved in a simple manner by positioning the thread eyelet of the tension feeler within the path of the delivered thread, and having positioned before it a first stationary guide eyelet and positioned after it a second stationary guide eyelet, such that in the case of normal delivery tension the thread eyelet lies between the two guide eyelets but moves out from between the guide eyelets during a drop in the tension, thereby forming a thread loop out of the subsequently delivered thread.

The tension feeler can advantageously take over a further function as a thread-breakage monitor, in that it in the case of a thread breakage can be moved, by the return spring which loads it against the thread tension, into a switching-off position in which the contact piece closes a cut-off circuit for the textile machine.

Further details and advantages of the invention can be taken from the description of an exemplary embodiment, which is illustrated in the single FIGURE of the drawing.

BRIEF DESCRIPTION OF THE DRAWING

The single drawing illustrates, in elevational view, a thread-delivery unit associated with a circular knitting machine, which illustrated unit has three thread-delivery devices associated therewith.

DETAILED DESCRIPTION

The drawing illustrates a device for the thread delivery to a processing place of a knitting machine, at which processing place threads of different color and/or composition are alternately processed. The device has therefore several, in the drawing three, inventive thread-delivery devices for positive thread deliveries. They are arranged on a common support frame 1, with which they can be mounted on a support ring 2, which ring supports thereon all devices of the machine for all knitting points.

All three thread-delivery devices are constructed in the same manner, so that their illustrated elements are identified with the same reference numerals except for the addition of the letters "a" or "b" when identifying the two lowermost devices.

Each thread-delivery device includes a thread-guiding roller 3, a thread-control device which as a whole is identified with reference numeral 4, and a tension feeler which is identified as a whole with reference numeral 5. All three thread-guiding rollers 3, 3*a* and 3*b* are supported rotatably on a common axle 6 which projects from the support frame 1. The associated thread-control devices 4, 4*a* and 4*b* are arranged elevationally movably on a common support rail 7 which projects from frame 1 substantially parallel with axle 6. A drivable delivery belt 8 rests on each thread-guiding roller 3 over a portion of its periphery, which belt loops around all thread-guiding rollers of the devices arranged at the same height for all processing points of the machine. The delivery belt 8 has a width which corresponds approximately with half the height of the thread-guiding roller 3, so that the thread-guiding roller has a peripheral area which is free of the delivery belt.

The thread-control device 4 has a thread-control element 9 of two swivel arms 10 and a swivel axle 11 which connects these in a U-shaped manner. The thread-control element 9 is supported on a housing 12 by means of the swivel axle 11 such that the two swivel arms extend in parallel on opposite sides of the thread-guiding roller 13. Each swivel arm 10 carries at its free end an eyelet 13 for the thread. An arm 14 of magnetic material is secured at its one end to the swivel axle 11, so that the arm projects from the axle at approximately a right angle with respect to the swivel arms 10. A spring 15 engages the free end of the arm 14, which spring is constructed as a tension spring, and the other end of which is secured on the housing 12 by means of a mounting 16. An electromagnet 17 is arranged in the housing 12 adjacent to the arm 14 so that it, when switched on, attracts the arm 14 against the force of the spring 15. The circuit of the electromagnet 17 (which will be described later on) and the circuits of further switching devices are schematically illustrated in the drawing outside of the device. Indeed, the current supply takes place through a contact strip in the support rail 7, which strip is known but is not illustrated for purposes of clarity.

The tension feelers 5 which are associated with each thread-delivery device are supported, when viewed by a person looking at the drawing, one behind the other on or in the support frame 1 such that they do not interfere with one another. Each tension feeler 5 has a first long lever arm 18 and a second short lever arm 19. The two lever arms are connected to one another through a disk 20 which is rotatably supported in the support frame 1. The first lever arm 18 extends outside of the support frame 1 with a length which corresponds approximately to the length of the support rail 7. Arm 18 is bent at its free end and carries there a thread eyelet 21. The second lever arm 19 is very short. Arm 19 projects from the disk 20 while being slightly angled with respect to the main direction of the lever arm 18, and carries a contact piece 22 at its free end. Same is placed on substance 23 through the second lever arm 19 and the disk 20. A return spring 25 eccentrically engages the disk 20 through a pin 24, the free end of which spring is held on the support frame 1 with a fastening means 26.

A contact 27 is arranged in the support frame 1 for cooperation with the contact piece 22, which contact 27 belongs to the circuit 28 for the electromagnet. When the contact piece 22 rests on the contact 27, the circuit is closed. Furthermore a second contact 29 of a cut-off circuit 30 for the knitting machine is arranged in the support frame 1 so that the contact piece 22 contacts it at a certain position of the tension feeler 5 to thereby stop the machine. A signalling lamp 31 is interposed in the cut-off circuit 30.

OPERATION

The operation of the described thread-delivery device is discussed in connection with the thread-control devices 4 and 4*a*, which illustrate two different operating conditions. The course of the thread F which belongs to the thread-guiding roller 3 and thread-control device 4 is illustrated with a broken line, the thread $F_a$ which belongs to the thread-guiding roller 3*a* and thread-control device 4*a* is illustrated with a dash-dotted line. In addition, the thread $F_b$ which belongs to the third thread-guiding roller 3*b* is illustrated with a dash-dotted line, however, without illustrating the tension feeler associated therewith.

The thread F is supplied from a source, such as a bobbin, through an inlet eyelet 32 to the thread-guiding roller 3. The thread, after passing through eyelet 32, then passes through the eyelets 13 so as to partially wrap around the roller 3. This thread is presently being processed on the knitting machine. It thus has a withdrawal tension which holds the tension feeler 5 against the force of the return spring 25, as illustrated. The thread eyelet 21 is, in this position on the swivel arm 18, between a first stationary guide eyelet 33 and a second stationary guide eyelet 34. The stationary guide eyelets for the threads $F_a$ and $F_b$ are arranged there-behind.

In the described position of the tension feeler 5, its contact piece 22 rests on the contact 27 and closes the circuit for the electromagnet 17. Same attracts the arm 14 against the force of the spring 15 and thus holds the swivel arms 10 of the thread-guiding element 9 in a position in which the two eyelets 13 are disposed on substantially diametrically opposite sides of the thread-guiding roller 3 at the level of the area around which the delivery belt 8 is looped. The thread F is thus moved by the delivery belt 8 and is forwarded to the knitting machine. In the position illustrated in the drawing, a thread delivery does not occur about the thread-guiding rollers 3*a* and 3*b* since the associated swivel arms 10*a* and 10*b* are in a position in which the threads $F_a$ or $F_b$ are outside of the area of the delivery belt. They are held in this position by the associated (not illustrated) springs 15*a* and 15*b*, since the circuits of the associated electromagnets are not closed. The associated tension feelers are approximately in the position assumed by the illustrated tension feeler 5*a*. The contact piece 22*a* has in this position no contact with its associated contact (equivalent to contact 27) which is disposed behind the contact 27.

As soon as a thread change takes place at the processing place, the thread F is separated there and is clamped, which causes the tension in the unwinding thread F to drop. This makes it possible for the return spring 25 to rotate the disk 20 and to thus swivel the tension feeler 5. Through this the connection between the contact piece 22 and the contact 27 is immediately interrupted and thus the circuit of the electromagnet 17. Through this the force of the spring 15 becomes active, which suddenly swivels the arm 14 and thus the swivel arms 10 in the direction of the arrow A and thus immediately moves the eyelet 13 and with it the thread F into the delivery-belt-free area of the thread-guiding roller 3. The thread-delivery device thus assumes an entirely new, intermediate position, as it is drawn for the thread-delivery device with the index "a". The little length of thread F which is still delivered during the swivelling operation forms a loop between the two stationary guide eyelets 33 and 34, which loop is held by the tension feeler 5.

At the same time, during normal operation the consumption of a different thread is initiated, for example the thread $F_a$. Since initially no delivery through the thread-guiding roller 3*a* occurs, first the thread storage which exists in the loop between the stationary guide eyelets and the thread eyelet 21*a* is consumed. The thread eyelet 21*a* is thereby pulled into the working position between the two stationary guide eyelets, the tension feeler 5*a* being swivelled therewith. Upon reaching the working position, as illustrated in the drawing by the tension feeler 5, the contact piece 22*a* contacts the associated contact (equivalent to contact 27) and closes the circuit of the associated electromagnet. Same attracts the arm 14*a* (which is not shown in the drawing) against the force of the spring 15*a* and thus immediately swivels the swivel arms 10*a* in direction of the arrow B. Through this the eyelets 13*a* and with them the section of thread $F_a$ which is provided between them are moved into the area of the thread-guiding roller 3*a* on which runs the delivery belt 8*a*. The delivery of the thread $F_a$ from roller 3*a* then starts.

In the case of a thread breakage between the processing point and the thread-delivery device, the tension feeler immediately interrupts, and prevents further, thread delivery in the above-described manner. However, in this case, the thread tension drops to zero so that a thread loop cannot form for holding the tension feeler in said intermediate position. The return spring 25 thus rotates the disk 20 so far that the contact piece 22 comes into contact with the contact 29. The cut-off circuit 30 which stops the knitting machine is thereby closed. The signalling lamp 31 lights up at the same time to indicate the breakdown point.

The invention is not limited to the exemplary embodiment. Important is the switching of the electromagnet through the tension feeler and the instantaneous swivelling of the thread-control element out of the effective range of the delivery belt. This can also be achieved through a direct engagement of the electromagnet on a swivel arm of magnetic material, which is loaded for example through a counterweight toward its releasing position.

The tension feeler can also be constructed with one arm, with one contact piece at a small distance from its swivel bearing and correspondingly arranged counter-contacts.

Reference is made to my copending applications Ser. No. 051 188, filed June 22, 1979, and Ser. No. 68,352, filed concurrently herewith the disclosures of which are incorporated herein by reference.

What is claimed is:

1. A positive thread-delivery device for a textile, in particular a knitting, machine with a plurality of thread-guiding rollers, with which cooperates a common delivery belt and with which each one a thread-control element is associated, which thread-control element during the delivery of the thread holds same in a clamping position between the delivery belt and the thread-guiding roller and which during a drop in the tension of the thread which is delivered by the thread-delivery device can be changed over into a position in which it guides the thread over an area of the thread-guiding roller which is free of the delivery belt to thus terminate the thread delivery, comprising the improvement wherein a tension feeler is provided which engages, independently from the thread-control element, the thread which is delivered by the thread-delivery device, and which feeler operates an electromagnet which loads the thread-control element.

2. Device according to claim 1, with a swingably-supported thread-control element which is loaded by a spring in the direction of the position which guides the thread over the delivery-belt-free area of the thread-guiding roller, wherein the spring engages the free end of a magnetic arm which is connected to the thread-control element in the vicinity of its swivel axis, and wherein the electromagnet is arranged adjacent to the arm so that it, when switched on, swivels same against the spring force.

3. Device according to claim 2, wherein the tension feeler has two lever arms with a thread eyelet for the delivered thread at the free end of the first lever arm and a contact piece at the end of the second lever arm, and is supported and spring-loaded such that the contact piece during normal delivery tension of the delivered thread closes the circuit of the electromagnet and opens same when the tension drops.

4. Device according to claim 3, wherein a first stationary guide eyelet is arranged in front of and a secondary stationary guide eyelet is arranged after the thread eyelet of the tension feeler in the path of the delivered thread, such that during the delivery of normally tensioned thread the thread eyelet lies between both guide eyelets but moves out from between them when the tension drops, thereby forming a thread loop out of the subsequently delivered thread.

5. Device according to claim 3 or 4, wherein the tension feeler during thread breakage can be moved by the return spring into a switching-off position in which the contact piece closes a cut-off circuit for the textile machine.

6. Device according to claim 3, wherein the two lever arms forming the tension feeler are connected through a rotatably supported disk and the return spring eccentrically engages said disk.

7. Device according to claim 6, wherein the disk, the return spring, the second lever arm and areas of the circuits which cooperate with the contact piece, are arranged in a support frame for the thread-guiding roller and the thread-control element.

8. Device according to claim 7, wherein the circuit for the electromagnet is guided through a support rail for the thread-control element.

* * * * *